United States Patent [19]

Szczupak

[11] Patent Number: 4,582,466

[45] Date of Patent: Apr. 15, 1986

[54] VARIABLE INLET AREA TURBINE

[75] Inventor: David T. Szczupak, Huddersfield, England

[73] Assignee: Holset Engineering Company Limited, Turnbridge, England

[21] Appl. No.: 628,006

[22] Filed: Jul. 5, 1984

[30] Foreign Application Priority Data

Jun. 11, 1981 [DE] Fed. Rep. of Germany ..... 3123185

Jul. 8, 1983 [GB] United Kingdom ..... 8318489

[51] Int. Cl.[4] ..... F01D 17/16

[52] U.S. Cl. ..... 415/150; 415/158

[58] Field of Search ..... 415/150, 157, 158; 60/600–603; 417/407

[56] References Cited

U.S. PATENT DOCUMENTS 2,861,774 11/1958 Buchi ..... 415/150 UX 4,292,807 10/1981 Rannenberg ..... 415/158 X 4,378,194 3/1983 Bandukwalla ..... 415/158 X 4,403,538 9/1983 Rise ..... 60/602 X

FOREIGN PATENT DOCUMENTS 1138941 1/1969 United Kingdom ..... 415/158

*Primary Examiner*—Robert E. Garrett

*Assistant Examiner*—Joseph M. Pitko

*Attorney, Agent, or Firm*—Gary M. Gron; Robert T. Ruff

[57] ABSTRACT

The disclosure illustrates a turbocharger comprising a radially inward flow turbine and a vaned inlet turbine nozzle. A variable inlet area is provided by an annular control ring continuous at its inner diametrical face and having slots extending inward from its radially inner portion of the vanes. The control ring may be attached to a steel stamping which, in turn, is attached to shafts of a pair of actuators for axially displacing the control ring and thus varying flow area through said turbine nozzle. By only partially embracing the inlet canes, the possibility of sticking due to carbon build-up is minimized if not eliminated.

17 Claims, 8 Drawing Figures

VARIABLE INLET AREA TURBINE

The present invention relates to a variable inlet area turbine that can be employed with turbochargers.

Turbochargers are used extensively in modern diesel engines to improve fuel economy and minimize noxious emissions. Such a turbocharger comprises a turbine wheel and housing, a compressor wheel and housing, and a central cast bearing housing between the wheels. The turbine wheel rotates when driven by exhaust gases from an internal combustion engine and causes the compressor wheel to which it is coupled to rotate and compress air for delivery to the engine at a rate that is greater than the rate the engine can naturally aspirate. The turbocharger pressure output is a function of component efficiencies, mass flow through the turbine and compressor and the pressure drop across the turbine.

One problem that occurs with turbochargers is that acceleration of an engine from a relatively low rpm is accompanied by a noticeable lag in the pressure increase from the turbocharger resulting in a noticeable lag in response. The reason for this is that the inlet area of the turbine is designed for maximum flow and velocity at rated conditions. As a result, the velocity of the gases passing across the turbine wheel at low engine rpm allow the turbocharger rpm to drop to such a low level that a substantial increase in exhaust gas velocity is required to increase the turbocharger rpm.

In order to overcome this deficiency, it has been proposed to provide the turbocharger with a variable turbine inlet area so that at low engine rpm the area may be made small to increase the velocity of the exhaust gases and maintain the turbocharger at a sufficiently high rpm to minimize lag.

In one proposal an annular ring is movable across the turbine inlet to vary the axial dimensions of the inlet and thus increase or decrease the overall inlet area. The ring has a series of openings which conform to and receive fixed turbine inlet vanes to permit free axial movement of the ring. These openings in the ring are wholly located between the radially inner and outer boundaries of the ring and thus each hole is completely bounded by the material of the ring. In such proposal the inlet area leads from a volute which itself has an entrance connected to an exhaust manifold of an internal combustion engine providing exhaust gases to drive the turbine. This volute and its entrance are part of a turbine housing surrounding the turbine wheel. This housing is fastened to a bearing housing carrying a shaft driven by the wheel. The inlet vanes are mounted on the turbine housing, whereas the ring is mounted on the bearing housing. Since the vanes are engaged in the holes in the ring it is not possible to rotate the turbine housing relative to the bearing housing (or vice-versa) about the shaft axis.

To achieve proper lubrication of the turbocharger (delivery and return), it has to be mounted in a predetermined attitude. Because the entrance to the turbine volute cannot be varied by rotation of the turbine housing relative to the bearing housing, the places where the turbocharger can be mounted in the predetermined attitude and where it can conveniently and optimally receive exhaust gas from the engine exhaust manifold can be very limited in, for example, the engine compartment of a motor vehicle powered by an internal combustion engine. If the entrance to the volute could be rotated, relative to the bearing housing, about the shaft axis so that the position of the entrance could be adjusted to conveniently and optimally receive the exhaust gas a greater choice of mounting sites for the turbocharger becomes available.

In addition, the deposit laden exhaust of an internal combustion engine can fill up the space between the vanes and the wholly surrounding walls of the openings in the ring and cause the ring to stick to the vanes which makes it more difficult to move and impairs its modulating function.

Furthermore, the forming of accurately shaped openings to conform to the shape of the vanes can be expensive.

According to the invention a turbine for use with an internal combustion engine comprises a turbine housing, a radial inward flow turbine wheel mounted for rotation within the housing, said housing having an annular inlet passage adjacent the periphery of the turbine wheel through which passage heated engine exhaust flows for driving the wheel, a plurality of vanes disposed in the passage so that fluid flow is between the vanes, means for controlling the flow area of the passage, said control means comprising a control ring having radially inner and outer diametrical faces, a plurality of slots formed in the control ring, each slot being open at one of said diametrical faces and extending part way through the control ring towards the other diametrical face, each slot partially embracing a vane having, with respect to the control ring, radially inner and outer portions of which only one of said portions is in the slot, said control ring being displaceable along its central axis so as to move relative to the vanes, and means for displacing the control ring so as to vary the flow area of the passage.

The above and other related features of the present invention will be found from a reading of the following description of the disclosure shown in the accompanying drawings and the novelty thereof pointed out in the appended claims.

Figure 1:
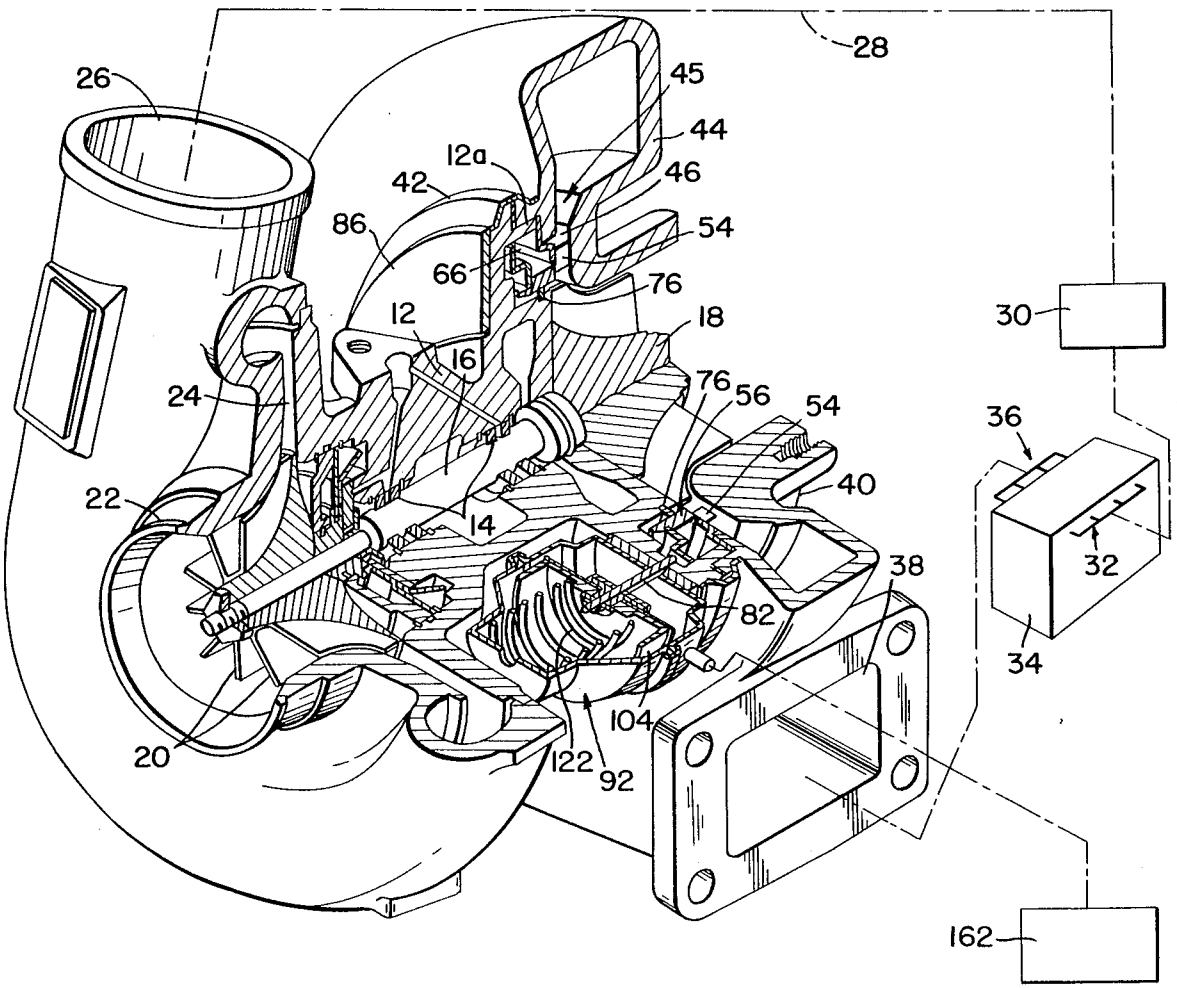
FIG. 1 is a simplified perspective view, partly in section, of a turbocharger which incorporates a variable inlet area turbine formed according to the invention.

With reference to FIGS. 1 to 6, FIG. 1 shows a turbocharger comprising a central cast bearing housing 12 having a pair of sleeve bearings 14 for supporting a shaft 16 that is attached to a radial inward flow turbine wheel 18. The turbine wheel 18 drives the shaft 16 which is in turn connected to a centrifugal impeller 20, journalled within an impeller housing 22. Rotation of the impeller 20 accelerates air which is discharged into an annular diffuser 24 and then to a scroll-like outlet 26 for converting the velocity head into a static pressure head. Pressurized air is directed from the outlet 26, through an appropriate conduit 28, through an aftercooler 30 if desired, and then to an intake manifold 32 of a reciprocating internal combustion engine 34. The internal combustion engine utilizes the compressed air to form part of a combustible mixture which burns to drive the engine. The products of combustion are fed through an exhaust manifold 36 to an entrance or inlet 38 of an inlet volute 44 of a turbine housing 40 which is secured to the bearing housing 12 by a clamp band 42. As illustrated the inlet volute 44 has a single passage of gradually decreasing area. Alternatively the inlet volute 44 may be in the form of a twin flow volute in which a pair of inlets, connected to different groups of engine cylinders, leads to annular passages separated by an annular dividing wall, the inner radius of which is adjacent an annular inlet passage 45 consisting of opposed, radially extending side walls 46 and 48 respectively. The wall 46 is integral with the turbine housing 40, but the wall 48 is a radially inwardly directed flange on a ring 50 having an integral radially outwardly extending flange 52. The flange 52 is clamped between a flange 12*a* of the housing 12 and a side part 40*a* of the turbine housing 40. An annular array of flow directing vanes 54 are mounted cantilever fashion on flange 48 by any suitable method, for example welding. The vanes 54 extend radially inwardly beyond radially inner edge 48*a* of the flange 48. The vanes 54 are orientated so that they direct incoming gas flow generally in a tangential direction and radially inward to provide the appropriate gas flow. The vanes 54 extend across the inlet passage 45 and come close to or simply touch the wall 46.

Figure 3:
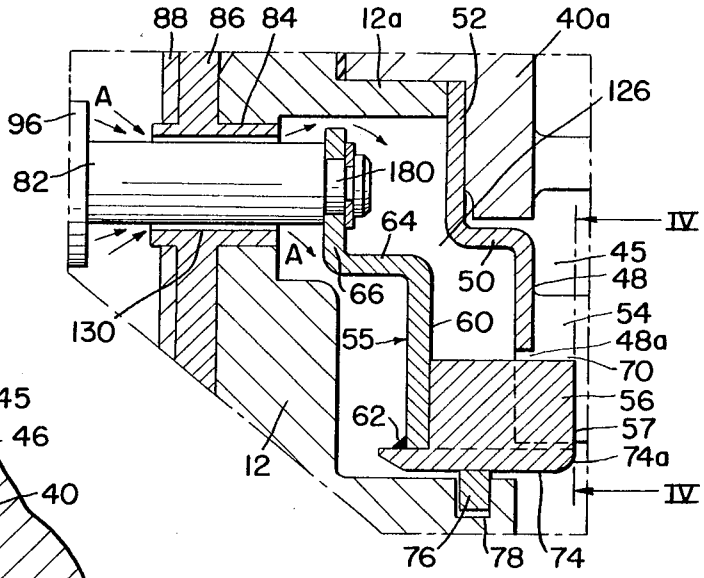
FIG. 3 is an enlarged fragment of FIG. 2, with the variable area turbine partially open.
Figure 2:
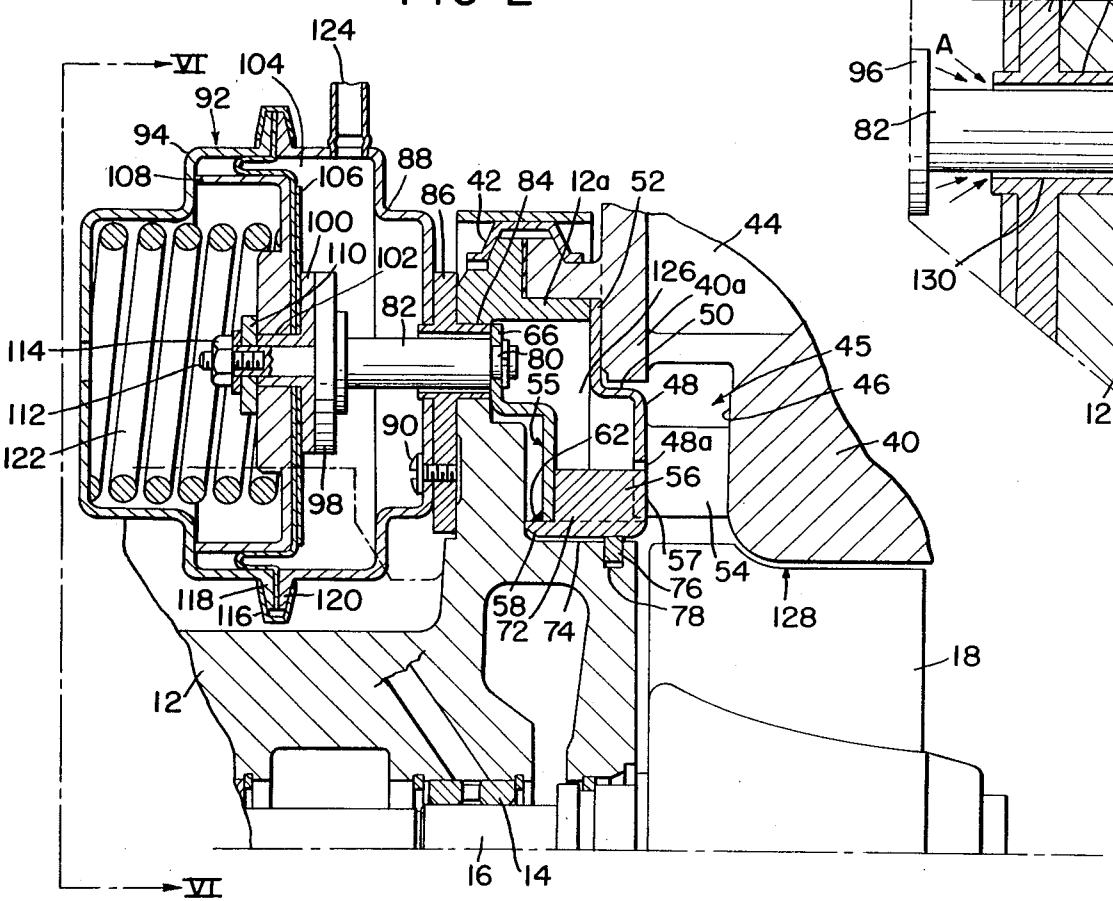
FIG. 2 is a fragmentary longitudinal section view on an enlarged scale of the turbocharger illustrated in FIG. 1.
Figure 5:
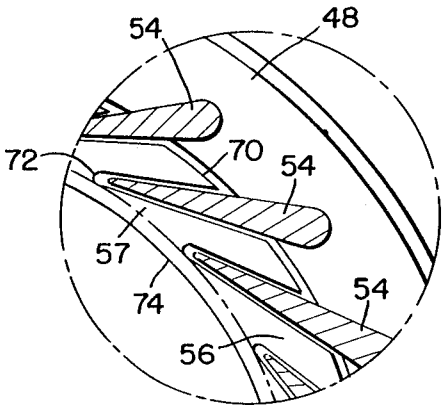
FIG. 5 is an enlarged fragment of FIG. 4.
Figure 4:
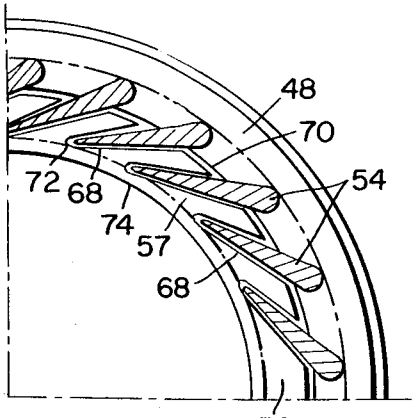
FIG. 4 is a fragmentary section on a reduced scale, on line IV—IV in FIG. 3.

As shown in FIGS. 2 and 3 a variable control mechanism is incorporated in the turbocharger. The mechanism comprises an area control element 55 formed with a relatively thick walled annular control ring 56 (see also FIGS. 4, 5) having a front axial face 57 and being stepped at its rear axial face to form a radially inner rear flange 58. Disposed against the rear axial face and piloted over the flange 58 is an inwardly directed annular flange 60 secured to the rear of the ring 56, for example by welding 62. Flange 60 extends from a ring 64 having an outwardly directed flange 66.

The control ring 56, which is located radially inwardly of the edge 48*a* has a plurality of slots 68 (see particularly FIGS. 4 and 5) each partially embracing a respective vane 54. Each slot 68 is open at a radially outer diametral face 70 of the control ring, and a radially outer part of each vane extends radially outwardly beyond the face 70. Within the control ring 56, each slot 68 terminates in a base 72, which is radially outwardly of a substantially cylindrical inner diametral face 74 of the ring. Each slot 68 is open at the front face 57 of the control ring and is closed by the flange 60 at the rear. The slots 58 permit axial sliding movement of the control ring 56, between the wall 46 and 48. The radially inner diametral face 74 is in sliding contact with a metal sealing ring 76 disposed in annular groove 78 in the bearing housing 12.

The radially inner face 74 is chamfered or rounded at 74*a*. The radius is selected so as to provide a controlled and gradual expansion of gases as they leave the inner or down stream face of the control ring 56.

Flange 66 has a plurality of holes 80 each of which receives a shaft 82. As illustrated in FIG. 2, the hole 80 is a keyhole slot to receive and affix shaft 82 to flange 66. The shaft 82 also extends through sleeve formation 84 of an actuator mounting plate 86, and an actuator housing element 88. Housing element 88 is fixed to the actuator mounting plate 86 by screws 90. Plate 86 is in turn connected to bearing housing 12 by a plurality of fasteners, not shown. Shaft 82 connects with an actuator module 92 comprising an annular housing element 94 connected to element 88. Provided on shaft 82 is a shoulder 98 engaging an insulating bushing 100. Bushing 100 has a boss 102 to pilot a flexible rolling diaphragm 104 sandwiched between a disc 106 and cup 108. An insulating washer 110 is received over the threaded end 112 of shaft 82, and a nut 114 clamps the diaphragm and associated elements between washer 110 and shoulder 96. The outer periphery 116 of the rolling diaphragm 104 is clamped between flanges 118 and 120 of housing elements 94 and 88 respectively. A spring 122 acts against the interior of housing 94 to push diaphragm 104 and, in turn, shaft 82 towards the right as viewed in FIG. 2. The interior of housing element 88 receives a supply of pressurized air from a source 162 (FIG. 1) to vary the pressure in housing element 88, through an inlet fitting 124, in proportion to a control signal which may be taken from such engine operating parameters as engine boost pressure, engine speed or fuel pump rack setting.

Figure 6:
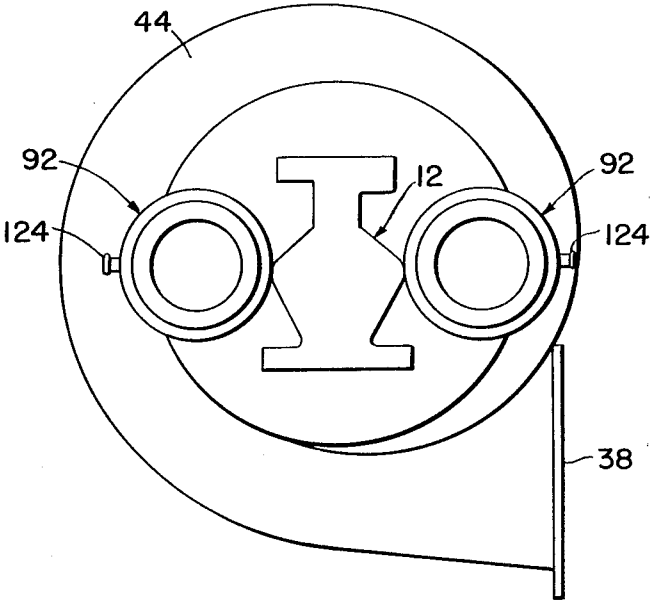
FIG. 6 is a diagrammatic cross-sectional view on line VI—VI in FIG. 2.

As shown in FIG. 6, actuator modules 92 are positioned to the side of the bearing housing 12. Preferably, there are two modules (only one is shown in FIG. 1) secured to points located 180 degrees from each other around flange 66.

During operation, the turbine wheel 18 is rotated by the passage of exhaust gases from engine exhaust manifold 36. Rotation of turbine wheel 18 causes impeller 20 to rotate and pressurize air for delivery to the intake manifold 32 of the engine 34. The spring 124 pushes the area control ring 56 towards a positioned of minimum flow (but not totally flow blocking) area. When the ring 56 is in this position, the ring 56 is a barrier to flow so that the gases must flow between it and the opposed wall 46 of the turbine housing. This causes the gas flow to accelerate and achieve a higher entry velocity around the turbine wheel 18. The increase in velocity causes an increase in turbine rpm to increase the air pressure in intake manifold 32. In response to a selected operating parameter the pressure within housing element 88 is varied. When the pressure within the housing element 88 exceeds a level predetermined by the strength of the spring 122, the air pressure moves the flexible diaphragm 104 thereby displacing the area control ring 56 to a more open position. This in turn increases the flow area and reduces the velocity of the gases entering the turbine. It can be seen then that the variable area control mechanism varies the velocity entering the turbine to achieve a controlled pressure level at the intake manifold 32.

Exhaust gases from passage 45 may enter a space 126 (FIGS. 2 and 3) to the side of flange 48 remote from passage 45. However, the sealing ring 76 prevents or substantially restricts such gases entering turbine chamber 128 through the middle of control ring 56 by passing along the inner face 74. Therefore the gases are wholly or substantially wholly compelled to enter the turbine chamber through the path between the wall 46 and the front face 57 of control ring 56.

As shown in FIG. 3 there is a small clearance 130 between the exterior of the shaft 82 and its sleeve bearing 84. As indicated by arrows A, motive fluid, i.e., air, can leak from actuator housing element into space 126. This escaping air, which is relatively cool, has a cooling effect on the shaft 82 and also on parts of the turbocharger, for example the flange 66 and ring 64 adjacent to the flow path of the escaping air.

The variable area control mechanism of FIGS. 1 to 3 and 6 is set up to push the flow area control element 62 towards a minimum area position or even to completely close the inlet passage 45 in the absence of a control signal. The mechanism shown in FIGS. 7 and 8 pushes the area control ring 62 towards to completely close the inlet passage 45 in the absence of a control signal. The mechanism shown in FIGS. 7 and 8 pushes the area control ring 62 towards a maximum area position. In this latter embodiment, in which parts that are identical to those of FIGS. 1 to 6 have identical reference numbers, actuator modules 140 each have a second housing 142 secured to housing 144 by a clamp band 146. The periphery of diaphragm 148 is clamped between housings 142 and 144. The movable center portion is sandwiched between plate 149 and cup 150 which are fixed against a shoulder 152 of an actuating shaft 154 by the insulating bushing 100, insulating washer 110 and the nut 114. Shaft 154 is arranged to abut and connect with flange 66 of the area control element 55. Housing 144 receives a supply of pressurized air through an inlet fitting 156 to push diaphragm 148 to the right.

Figure 7:
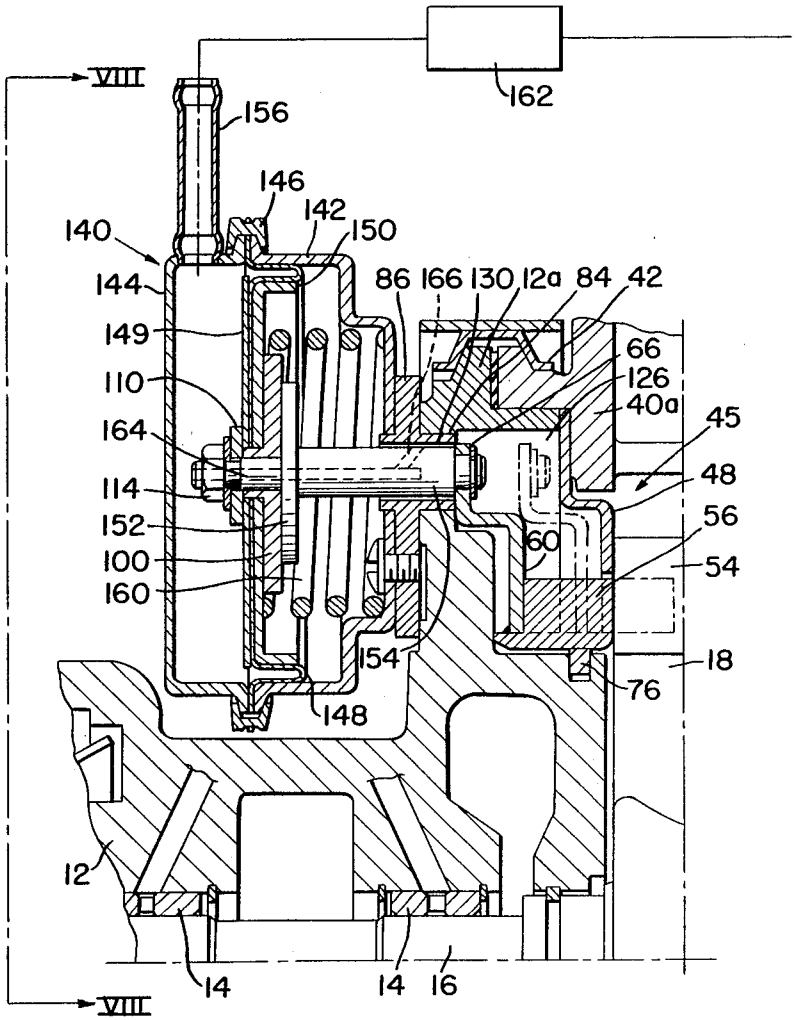
FIG. 7 is a fragmentary longitudinal sectional view, illustrating an alternative embodiment of the present invention.
Figure 8:
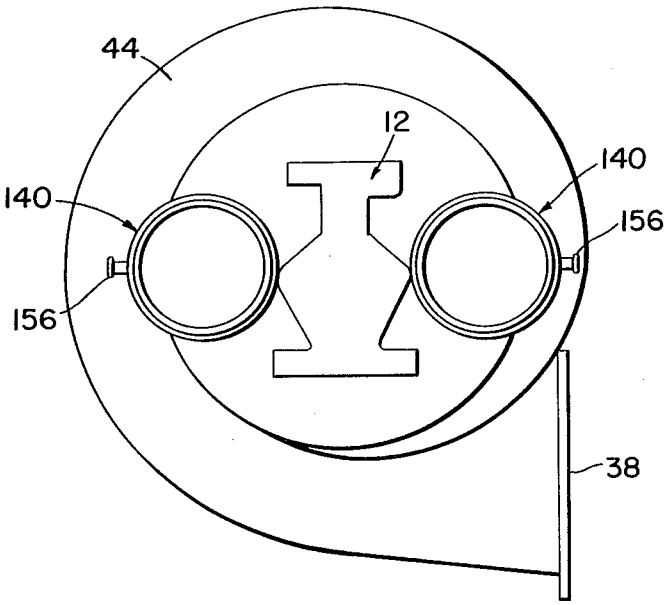
FIG. 8 is a diagrammatic cross-sectional view on line VII—VII in FIG. 7.

As shown in FIG. 7 each actuator module 140 includes a spring 160 urging the diaphragm 146 and shaft 154 to the left. In operation, the variable turbine area assembly of FIGS. 7 to 8 is biased to the open portion illustrated in FIG. 7 by the springs 160. The pressure in housing 144 can be provided from a source 162, and may be proportional to an engine operating parameter such as engine boost pressure, speed or fuel pump rack setting. For example, the intake manifold pressure may be used to control a pilot valve which directs pressurized air from supply source 162 to the chamber 144.

The stroke of actuating shaft 154 is sufficient to displace the area control ring 56 against turbine housing wall 46 and substantially block flow into the turbine wheel 18. If desired, the pressure in chamber 144 may be elevated to a high level, in cooperation with termination of fuel to engine 34 so that the area control ring 56 blocks flow and acts as a compression brake for engine 34.

Each shaft 154 has a central passage 164 opening at one end into the chamber 144 and by a branch passage 166 into the clearance 130 between the shaft and the sleeve bearing 84. Air from housing 144 can escape via passages 164 and 166 and has a cooling effect in the shaft, the bearing 84 and other components as aforesaid.

The means for controlling the air pressure in chamber 88 may be direct when intake manifold pressure is used as the pressure source.

When the turbocharger is being mounted in place, the angular position of the inlet 38 with respect to the axis of the shaft 16 can be varied as desired by releasing the clamp band 42, then rotating the turbine housing about the shaft axis relative to the vanes 54 and finally reapplying the clamp band.

Because the turbine vanes are only partially embraced by the slots 68, the mutually facing surface areas of each vane 54 and the walls of the corresponding slot 68 can be small. If the turbine fluid is exhaust gas the vanes may become wholly covered by deposits from the gas. But since the actual amount of such deposit which tends to oppose movement of the control ring is limited to that between the aforesaid mutually facing surface areas, that amount can also be small such that the opposition provided by the deposit to control ring movement can be relatively small and more easily overcome by the actuation system.

The slots 68 may all open at the radially outer diametrical face of the ring, therefore the radially outer portion of each vane is disposed beyond the outer face of the ring. Taking the depth of a vane 54 as being its dimensions, along the direction of the vane, between the radially inner or downstream and outer or upstream extremities of that vane, only substantially half or a minor portion of the vane 54 depth may be disposed in the corresponding slot 72.

Since the turbine housing forms one side of the turbine inlet passage, and the vanes 54 extend from the opposite side of the passage towards the first side, the turbine housing may be rotatable relative to second side of the passage about the axis of rotation of the turbine wheel irrespective of the orientation of the outer housing.

As a result, a high degree of flexibility is provided in mounting and orienting the turbocharger on an engine.

While a specific embodiment of the present invention has been described it should be apparent to those skilled in the art that it may be practiced in other forms without departing from the spirit and scope thereof.

Having thus described the invention what is claimed as novel and desired to be secured by Letters Patent of the United States is:

1. A turbine for use with an internal combustion engine, said turbine comprising:

a housing having an inlet for receiving engine exhaust gases and a radially inwardly directed annular passage connected to said inlet, a radial inward flow turbine wheel mounted for rotation within the housing and receiving exchaust gases from said annular passage, a plurality of flow directing vanes positioned within said annular passage, means for controlling the flow area through said passage, said control means comprising a control ring having inner and outer diametral faces, a plurality of slots formed in said control ring, each slot being open at the outer diametral face and extending part way through the control ring towards the inner diametral face, each slot partially embracing a vane having, with respect to the control ring, radially inner downstream and outer upstream portions of which only the downstream portion is in the slot whereby the outer diametral face of said control ring forms a circular leading edge in between the vane for gases passing inward toward said turbine, said control ring being displaceable along its central axis so as to move relative to the vanes, and means for displacing the control ring so as to vary the flow area of the passage.

2. A turbine as in claim 1 wherein said displacing means displaces said control ring against one of the walls of said annular passage thereby blocking flow and providing a compression brake for said engine.

3. A turbine as in claim 1 wherein said flow directing vanes extend across the inwardly directed annular passage.

4. A turbine as in claim 3 further comprising means for cantileverly mounting said vanes in said inwardly directed annular passage.

5. A turbine as in claim 4 wherein said cantileverly mounting means comprises a thin sheet metal annular stamping mounted to said housing and having a flange to which the ends of said vanes are mounted.

6. A turbine as in claim 5 further comprising a bearing housing connected to said turbine housing at an annular interface, said bearing housing containing means for journalling said turbine wheel and wherein said annular stamping further comprises an annular radially outwardly directed flange sandwiched between the interface so as to permit orientation of the turbine housing irrespective of the orientation of said bearing housing.

7. A turbine as in claim 6 wherein said vanes are mounted so that a portion thereof extends radially inwardly from the innermost edge of said annular stamping.

8. A turbine as in claim 6 wherein said flow control means further comprises an annular sheet steel stamping having a radially inwardly directed flange to which is attached one end face of said control ring.

9. A turbine as in claim 8 wherein said flow control means further comprises an integral annular sleeve having one end thereof extending from the radially outward portion of said radially inwardly directed flange and a radially outwardly extending flange at the opposite end of said sleeve portion to which radially outwardly directed flange said displacing means is attached.

10. A turbine as in claim 8 wherein said bearing housing includes a sleeve portion coaxial with and adjacent the inner diametrical face of said control ring and wherein said turbine comprises seal means positoned between said inner diametrical face of the control ring and said bearing housing sleeve portion.

11. A turbine as in claim 10 wherein said stamping for cantileverly mounting said vanes further comprises a sleeve portion in between and connecting said flanges, said sleeve portion loosely piloting, over its inner diameter, the sleeve portion on said control ring.

12. A turbine as in claim 10 wherein said actuator means comprises at least one displaceable shaft having one end thereof mounted to the radially outwardly directed flange of said control means and extending through an opening in said bearing housing and an actuator connected to the opposite end of said shaft.

13. A turbine in claim 12 wherein said actuator comprises a housing connected to said bearing housing and containing a diaphragm having the outer periphery thereof connected to said housing and the inner portion thereof connected to a disc on the shaft, one side of said diaphragm being connectable to a source of pressurized control fluid, said actuator further comprises means for yieldably urging said diaphragm in a direction opposite to that coopted by increasing fluid control pressure.

14. A turbine as in claim 13 wherein there is maintained a controlled clearance between such shaft and bearing housing opening and said turbine further comprises means for pressuring the annular space around said opening so as to produce a fluid flow into said turbine housing for cooling purposes.

15. A turbine as in claim 13 wherein the side of the diaphragm towards said turbine is connectable to said control fluid, said actuator housing sealingly surrounding the opening through which said shaft extends thereby providing said pressurizing means.

16. A turbine as in claim 13 wherein the side of the diaphragm away from said turbine housing is connectable to said control fluid, said shaft having an internal passage connected at one end to the portion of the housing connectable to said control fluid and at the other end adjacent said opening thereby providing said pressurizing means.

17. A turbine as in claim 13 wherein said actuator further comprises means for insulating said diaphragm from said shaft.

* * * * *